United States Patent [19]

Nevels et al.

[11] Patent Number: 4,598,774

[45] Date of Patent: Jul. 8, 1986

[54] SETTING TOOL WITH RETRACTABLE TORQUE FINGERS

[75] Inventors: David L. Nevels, Woodlands; John L. Baugh, Huntsville, both of Tex.

[73] Assignee: Hughes Tool Company, Houston, Tex.

[21] Appl. No.: 761,224

[22] Filed: Jul. 31, 1985

Related U.S. Application Data

[63] Continuation-in-part of Ser. No. 633,818, Jul. 24, 1984, abandoned.

[51] Int. Cl.[4] ..... E21B 23/02

[52] U.S. Cl. ..... 166/382; 166/124; 166/208

[58] Field of Search ..... 166/382, 123–125, 166/181, 182, 207, 208

[56] References Cited

U.S. PATENT DOCUMENTS

| | | | |
|---|---|---|---|
| 3,136,367 | 6/1964 | Wright et al. | 166/124 |
| 3,158,201 | 11/1964 | Springer | 166/208 |
| 3,171,491 | 3/1965 | States | 166/124 |
| 4,256,179 | 3/1981 | Shillander | 166/237 |
| 4,287,949 | 9/1981 | Lindsey, Jr. | 166/208 |
| 4,440,233 | 4/1984 | Baugh et al. | 166/382 |
| 4,441,560 | 4/1984 | Baugh et al. | 166/382 |
| 4,489,781 | 12/1984 | Weeks | 166/208 |

*Primary Examiner*—James A. Leppink
*Assistant Examiner*—Hoang C. Dang
*Attorney, Agent, or Firm*—Charles D. Gunter, Jr.

[57] ABSTRACT

A setting tool is shown if the type adapted to be made up in a pipe string for releasably engaging a setting sleeve in a well bore. The setting tool is designed to set a liner hanger using right hand as well as left hand rotation and is released from the setting sleeve using right hand rotation. A plurality of retractable, spring loaded torque fingers carried on a torque collar are used to transmit torque to the setting sleeve but are moved into a retracted position after the setting sleeve is released to avoid damage to the torque fingers. A plurality of splines and a splined ring within the torque collar are used to latch the tool in the running-in position to perform well bore operations, such as hanging a liner. The splines and splined ring have specially mating surfaces which form a key arrangement to facilitate reinsertion of the splines within the splined ring for subsequent operations as the tool is manipulated between the running-in and weight set down positions.

9 Claims, 10 Drawing Figures

SETTING TOOL WITH RETRACTABLE TORQUE FINGERS

This application is a continuation-in-part of an application by the same inventors, Ser. No. 633,818, filed July 24, 1984, entitled "Setting Tool with Retractable Torque Fingers", now abandoned.

BACKGROUND OF THE INVENTION

The present invention relates generally to oil well setting tools of the type adapted for engaging a setting sleeve run on a pipe string into a well bore, and specifically to a setting tool which allows left and right hand torque to be used during well bore operations as well as right hand torque to release the setting tool from the setting sleeve.

Setting tools are used for various purposes during well drilling and completion operations. As an example, a setting tool is typically used during setting of a liner hanger in a well bore. The setting tool is made up as a part of the pipe string between the liner hanger and the pipe string running to the well surface. The setting tool serves as a link to transmit torque to the liner hanger to hang the liner in a well bore. The setting tool is then typically manipulated from the well surface to effect a release of the setting tool from the liner hanger and the liner is then cemented into place in the well bore.

In a typical well drilling pipe string, the lengths of pipe are connected by tool joints with right hand threads which are released by left hand torque. Drilling is thus carried out by clockwise rotation of the drill string to avoid breaking out of the tool joints making up the pipe string. In certain prior setting tool designs, connecting threads were used to engage the setting tool with the setting sleeve which were releasable by right hand torque on the pipe string from the surface. However, this necessitated holding left hand torque on the pipe string while running into the well bore and dictated that the liner be set to the left in order to avoid releasing the setting tool connecting threads. Because left hand torque was used to set the liner, the possibility existed that tool joints in the pipe string would be unscrewed and a joint broken out.

It is, therefore, preferred to utilize a setting tool which allows the liner to be set by applying right hand torque from the surface and which allows the setting tool to be released and pulled out of the well bore by applying a similar right hand torque. There exists a need, therefore, for a setting tool which will allow right hand torque to be used during setting of a liner hanger or similar tool which also allows right hand torque to be used to release the tool.

In certain prior tools, radially moving dogs were used to initially secure the setting tool to the setting sleeve. Vertical manipulation of the pipe string from the surface, accompanied by radial movement of the latching dogs, allowed torque to be transmitted to a setting nut to release the setting tool from the surrounding setting sleeve. The radial movement of the latching dogs presented a possible problem, in that sand and other contaminates could impede their action, causing the tool to malfunction.

In U.S. Pat. No. 4,441,560, issued Apr. 10, 1984 to John L. Baugh et al., a setting tool is shown which allows left and right hand torque for well bore operations and which is releasable by right hand torque. A plurality of fixed torque fingers were received within end notches on the surrounding setting sleeve to transmit torque to the setting sleeve to perform well bore operations. In field practice, operators would sometimes release the setting tool from the setting sleeve and thereafter temporarily set the setting tool back down upon the upper end of the setting sleeve. If the torque finger did not line up axially with the complimentary end notch of the setting sleeve, the torque finger could become damaged, bent or broken, requiring service. A need exists, therefore, for a setting tool with retractable torque fingers to avoid the possibility of damage during temporary weight set-down.

There also exists a need, therefore, for a device of the above type with means for facilitating realignment of the setting tool within the setting sleeve complimentary profile, whereby the setting tool can be reattached to apply further torque to the setting sleeve for further well bore operations.

A need also exists for a device which will allow the setting tool to be used to rotate the liner during the cementing operation without being attached to the liner by the setting nut.

The above described objects are accomplished by an improved setting tool design as will be described in the following written description.

SUMMARY OF THE INVENTION

The setting tool of the invention is adapted to be made up in a pipe string for releasably engaging a setting sleeve in a well bore. The setting tool has a mandrel having an upper end adapted to be connected in the pipe string and having a lower end. A setting nut is carried on the mandrel having external connecting threads for engaging mating threads located on the interior of the setting sleeve and disposed about the mandrel. The mandrel is slidably disposed within the setting nut when the setting nut is engaging the setting sleeve. The mandrel is slidable between an extended, running-in position and a weight set-down position.

A torque collar carried on the mandrel exterior has at least one axially slidable torque finger mounted thereon. The setting sleeve has at least one end notch which is adapted to receive the axially slidable torque finger. Latch means are provided within the torque collar for preventing relative rotational movement between the connecting threads of the setting nut and the setting sleeve when the mandrel is in the extended, running-in position and allowing relative movement between the connecting threads when the mandrel is in the weight set-down position to release the connecting threads.

The torque collar is a generally cylindrical member having a lower circumferential edge and the torque finger is axially slidable between a torque transmitting position in which a portion of the torque finger extends past the lower circumferential edge and a retracted position.

The torque collar circumferential edge rests upon an upper circumferential edge of the setting sleeve when the setting nut is engaging the setting sleeve. The torque finger is engageable with the setting sleeve end notch when the torque finger is axially aligned with the end notch.

The torque finger is forced to the retracted position by contacting the setting sleeve upper circumferential edge when the torque finger is moved out of axial alignment with the end notch. Preferably, the torque finger is spring biased toward the torque transmitting position. A plurality of axially slidable torque fingers can be mounted equidistantly about the exterior of the mandrel for alignment with mating end notches provided in the setting sleeve.

A plurality of torque transmitting splines are located on the mandrel exterior. A portion of each of the splines is received within a setting nut axial groove to allow torque transmitted to the mandrel to be transmitted to the setting nut when the mandrel is in the weight set-down position. Another portion of each spline is received within a mating interior surface of the torque collar when the mandrel is in the extended running-in position to thereby prevent the transmission of torque to the setting nut. Key means on the mating interior surface of the torque collar orient the torque transmitting splines during receipt of the splines within the torque collar to facilitate reengagement of the setting tool to the surrounding setting sleeve.

Additional objects, features and advantages will be apparent in the written description which follows.

DETAILED DESCRIPTION OF THE INVENTION

Figure 1A:
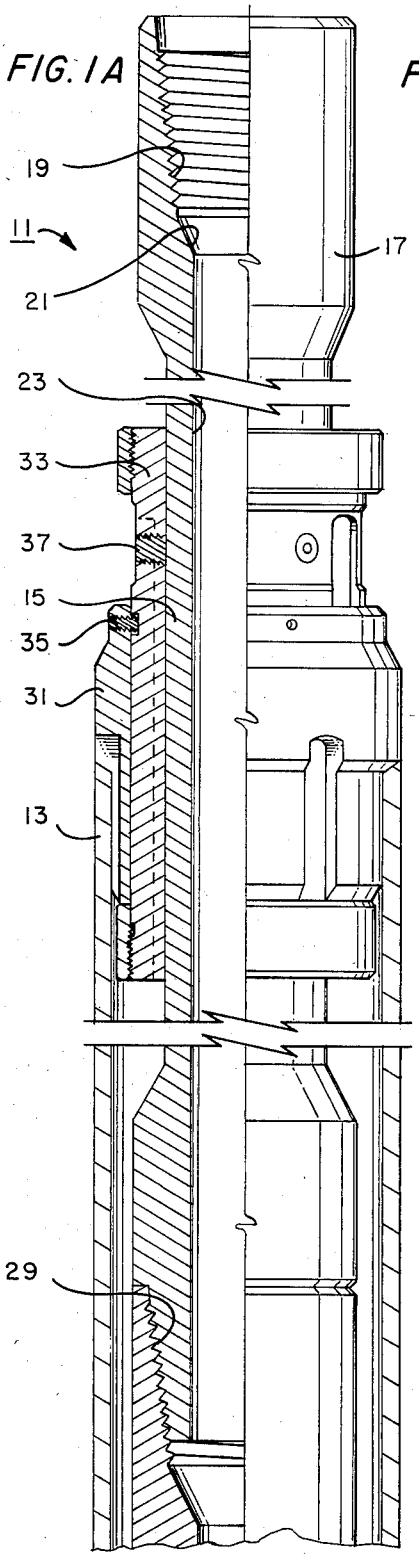
FIG. 1*a* is a side, partial cross-sectional view of the upper end of the setting tool of the invention in the running-in position.

Turning to FIG. 1*a*, there is shown a setting tool designated generally as 11 of the type adapted to be made up in a pipe string for releasably engaging a setting sleeve extension 13 in a well bore. By "well bore" is meant the annular space between the setting tool 11 and the casing, it being understood that the well bore could be unlined, as well.

Setting tool 11 includes a tubular mandrel 15 having an upper end 17 which is internally threaded at the upper extent 19 thereof for matingly engaging the external connecting threads of the lower extent of the pipe string (not shown) running to the well surface. The internally threaded upper extent 19 of the upper end 17 is connected by means of a tapered bore 21 to an internal bore 23 which runs through the remainder of the length of the mandrel to the lower end 25 which has an internally threaded surface 27.

The tubular mandrel 15 is comprised of upper and lower sections, as shown in FIG. 1*a*, which are connected by mating threads 29. Outer and inner support collars 31, 33 surround the upper portion of the tubular mandrel 15 and are retained in position by a plurality of pins 35, 37, respectively.

Figure 1B:
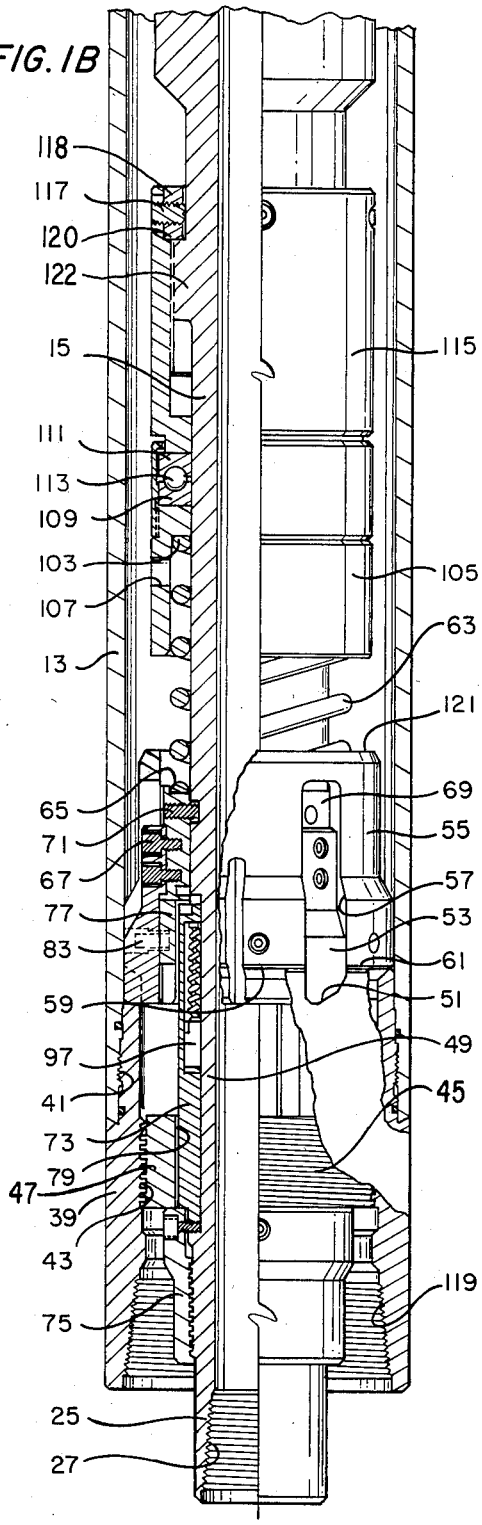
FIG. 1*b* is a downward continuation of the tool of FIG. 1 showing the running-in position.

As shown in FIG. 1*b*, the setting sleeve extension 13 extends from a setting sleeve sub 39 at the lower end thereof. The sub 39 has external connecting threads for engaging mating connecting threads 41 of the setting sleeve extension 13. The sub 39 also has an internally threaded profile 43 which matingly engages the external threads 45 of a setting nut 47. The setting nut 47 is carried on the tubular mandrel 15 about the lower end 49 thereof.

Figure 3A:
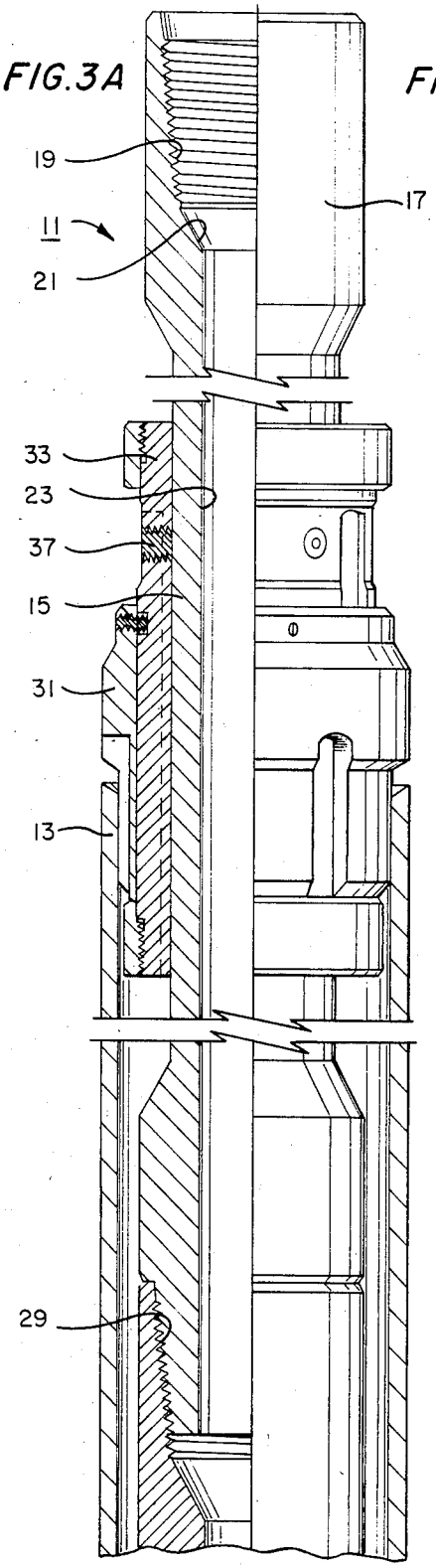
FIG. 3*a* is a side, partial cross-sectional view of the upper end of the setting tool similar to FIG. 2*a*.
Figure 3B:
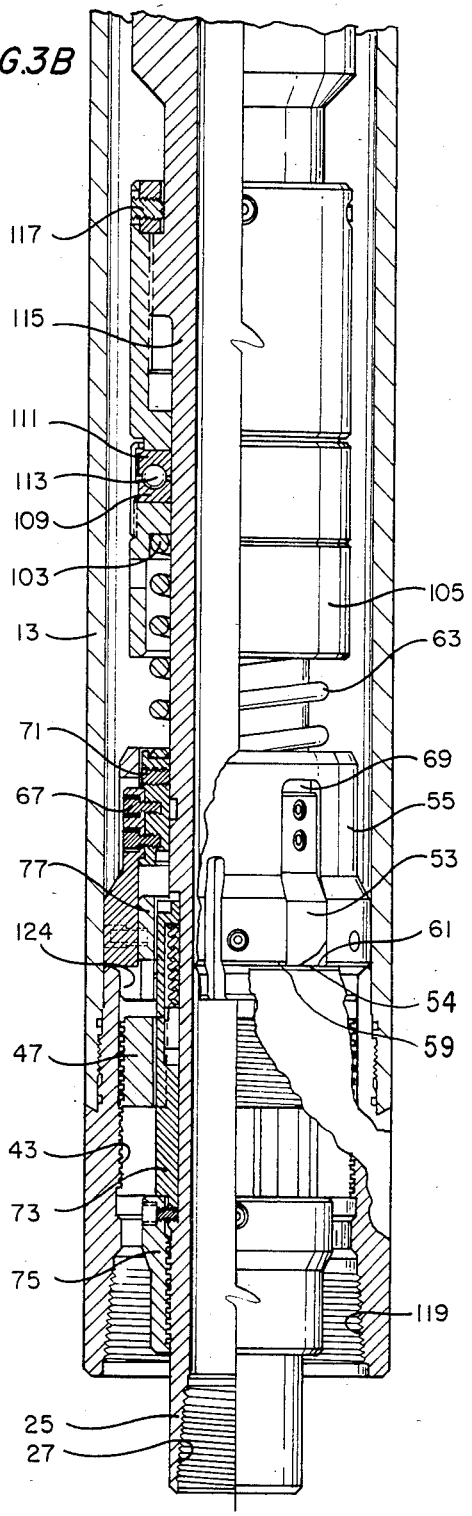
FIG. 3*b* is a downward continuation of FIG. 3*a* showing the setting tool in the weight set-down position with the connecting means disconnected.

The setting sleeve sub 39 is provided with end notches 51 for receiving the axially slidable torque fingers 53 of a torque collar 55. The torque collar 55, as seen in FIG. 1*b*, is a generally cylindrical member having a lower circumferential edge 59 and axial openings or slots 57 for receiving torque fingers 53. Each torque finger 53 is axially slidable in a plane parallel to the longitudinal axis of the tool between a torque transmitting position, as shown in FIG. 1*b*, in which a portion of the torque finger 53 extends past the lower circumferential edge 59 and a retracted position, as shown in FIG. 3*b*. In the "retracted" position of FIG. 3*b*, the torque fingers are completely received within the axial openings 57 in the torque collar 55 and the torque finger outer portions 54 do not extend past the lower circumferential edge 59.

In the running-in position shown in FIGS. 1*a* and 1*b*, the torque collar circumferential edge 59 rests upon an upper circumferential edge 61 of the setting sleeve sub 39. The setting nut 47 is engaging the setting sleeve sub 39 and the torque fingers 53 are engageable with the setting sleeve end notches 51 when the torque fingers 53 are axially aligned with said end notches 51.

Each torque finger 53 is spring biased for sliding movement in a plane parallel to the longitudinal axis of the tool toward the torque transmitting position by means of a coil spring 63 which surrounds the tubular mandrel and engages an upper ledge 65 of the torque fingers 53. The torque fingers 53 are mounted by means of screws 67 to a cylindrical latch ring 69 which surrounds the tubular mandrel 15 within the torque collar 55. As shown in FIG. 1*b*, the latch ring 69 is initially affixed by means of shear pins 71 to the tubular mandrel 15.

Figure 2A:
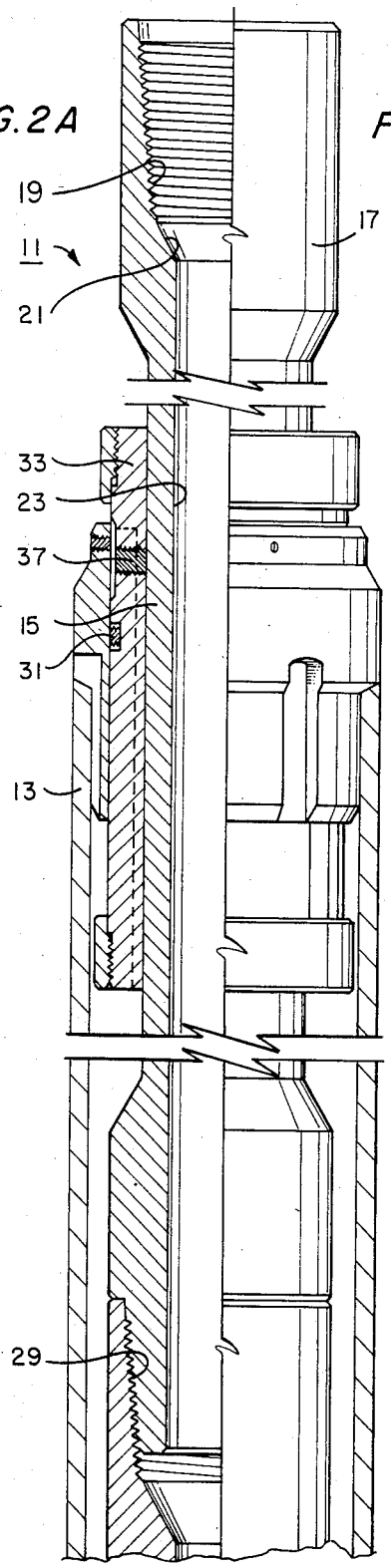
FIG. 2*a* is a side, partial cross-sectional view of the upper end of the setting tool in the weight set-down position.
Figure 2B:
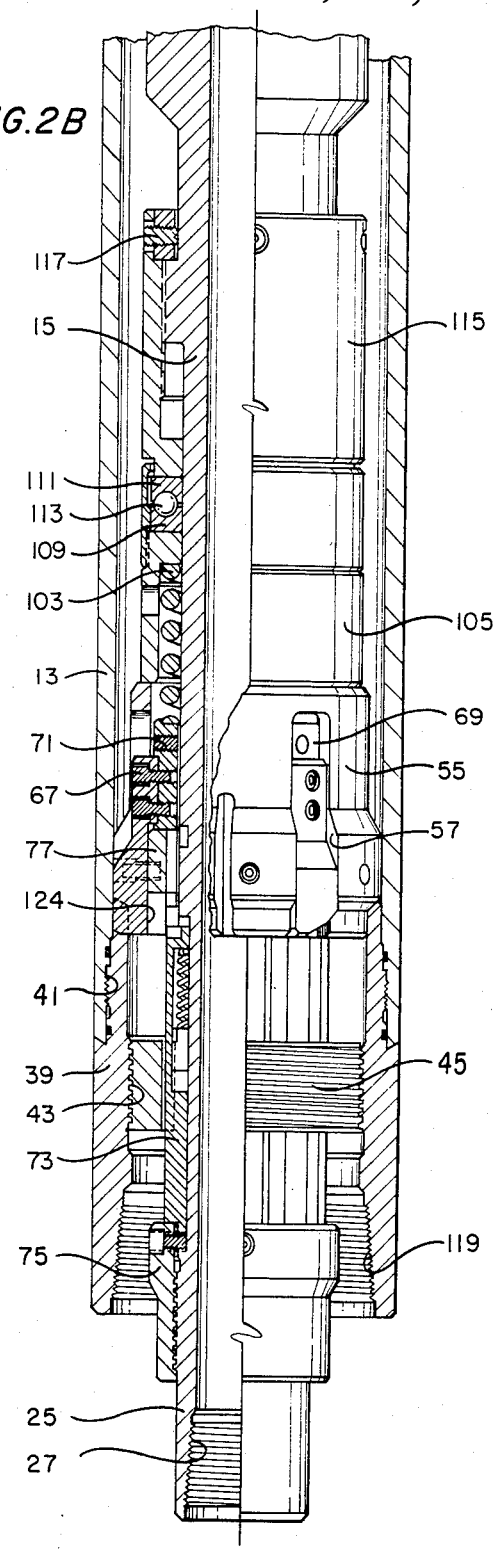
FIG. 2*b* is a downward continuation of FIG. 2*a* showing the setting tool in the weight set-down position with the connecting means still engaged.
Figure 5:
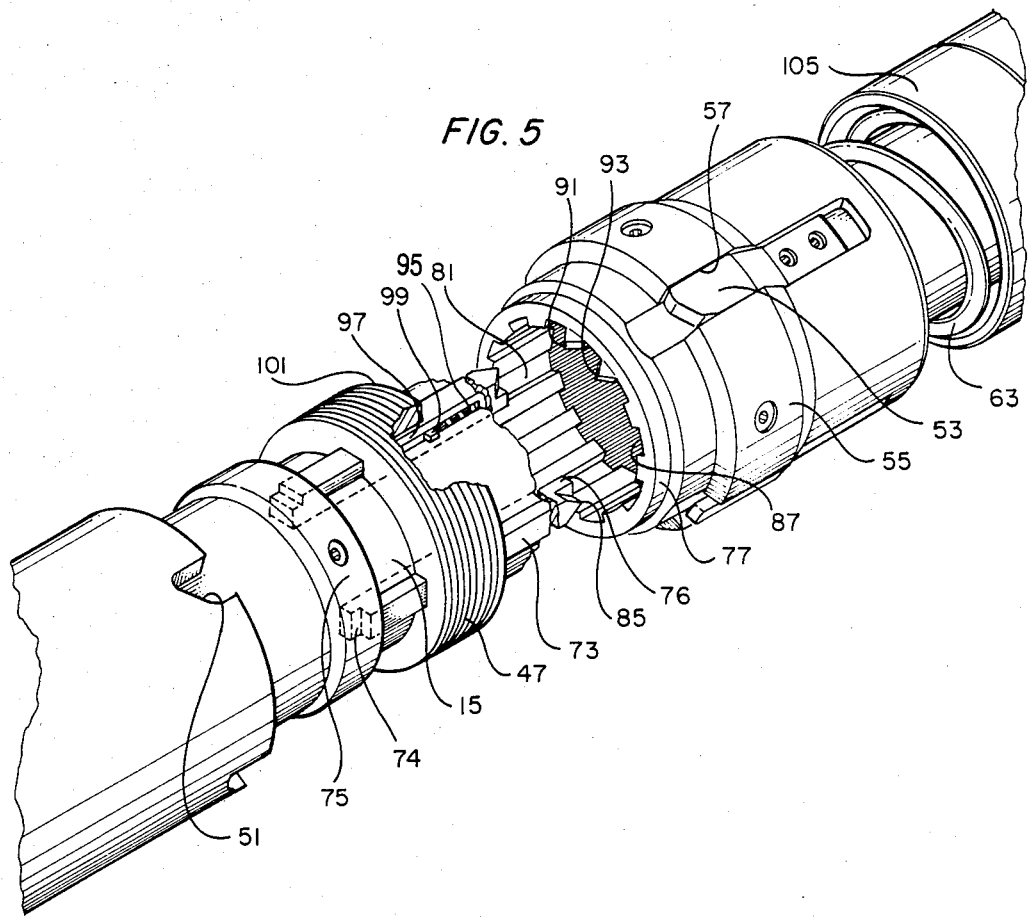
FIG. 5 is a perspective view of the setting tool of the invention with parts broken away.

Torque is transmitted to the setting nut 47 by means of a plurality of torque transmitting splines 73 carried on the mandrel exterior. As shown in FIG. 1*b* and FIG. 5, each spline 73 is retained by means of an end nut 75 at the lower extent thereof, the upper extents thereof being received within a mating interior surface of a splined ring 77 carried within the torque collar 55. A portion of each spline 73 is received within a setting nut axial groove 79 to allow torque transmitted to the mandrel 15 to be transmitted to the resting nut 47 when the mandrel is in the weight set-down position, as shown in FIGS. 2*b* and 3*b*. Another portion of each spline 73 is received within a mating interior surface (81 in FIG. 5) of the splined ring 77. Since the splined ring is initially pinned to the torque collar 55 by means of shear pins 83, torque transmitted to the mandrel 15 is transmitted through the splined ring 77 pins 83 and torque fingers 53 to the setting sleeve 13, in the position shown in FIG. 1*b*.

Figure 4:
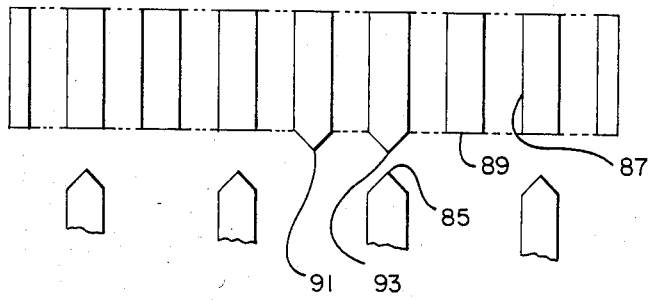
FIG. 4 is a schematic view of the key means and splined ring of the invention.

As shown in FIGS. 4 and 5, the splines 73 have pointed upper ends 85 which are adapted to be received within mating grooves 87 of the splined ring 77 as the tubular mandrel is moved axially upwardly and downwardly. Preferably, there are four torque transmitting splines 73, equidistantly spaced about the exterior surface of the mandrel 15. The splined ring 77 has a series of spaced grooves 87 which are separated by inwardly protruding regions 89. A pair of adjacent keys 91, 93 project downwardly from the splined ring mating interior surface 81 to locate and position the torque transmitting splines 73. As shown in FIG. 4, by providing four equidistantly spaced torque transmitting splines 73 with ends facing two points 91, 93 on the corresponding splined ring 77, the torque transmitting splines are automatically aligned for proper entry within the ring 77.

Each torque transmitting spline 73 is a longitudinal bar of generally rectangular shape. Each spline 73 has a step region 74 at the lower end thereof and a rectangular shaped flat 76 which underlies the pointed upper end 85. Each spline 73 also has an undercut area 95 adjacent the upper end thereof into which is received a spring biased dog 97. As best seen in FIG. 5, the spring biased dog 97 has a projecting ear 99 for engaging the upper surface 101 of the setting nut 47. In this way, a downward biasing force is applied to the setting nut 47 when in the disengaged position shown in FIG. 3*b* to facilitate reengagement of the setting nut with the internal threads of the setting sleeve should this be desired.

The coiled spring 63 (FIG. 1*b*) which rests upon the latch ring upper ledge 65 has an opposite end 103 which is retained within a cylindrical spring sleeve 105. A port 107 within the sleeve 105 allows the passage of fluids as the spring sleeve 105 is moved in the direction of the torque collar 55. Spring sleeve 105 contains a bearing arrangement including lower race 109, upper race 111, and a plurality of balls 113. A rotatable collar 115 rests upon the bearing arrangement whereby relative rotational movement between the rotatable collar 115 and the spring sleeve 105 is facilitated when the spring sleeve 105 contacts the torque collar 55, as shown in FIG. 2*b*. The rotatable collar 115 is affixed by means of a plurality of pins 117, to a ring 118 which, in turn, rests upon a shoulder 120 formed by a region of increased diameter 122 in the tubular mandrel 15. The region 122 has an externally threaded surface which engages mating threads provided in the interior of the rotatable collar 115.

The operation of the present invention will now be described. In a typical liner hanging operation, the setting tool of the invention would be made up in a pipe string by threading the upper end 17 (FIG. 1*a*) into the lower extent (not shown) of a pipe string running to the surface. The setting nut 47 (FIG. 1*b*) would be engaging the setting sleeve extension 13 by means of right hand release connecting threads 43, 47, respectively. The mandrel 15 would be spring biased by means of coil spring 63 in the extended running-in position shown in FIGS. 1*a* and 1*b*. Shear pins 71 fix the mandrel 15 to the latch ring 69 to retain the mandrel 15 in the extended running-in position until a predetermined downward force is applied to the mandrel through the pipe string from the surface. Thus, in the running-in position shown in FIGS. 1*a* and 1*b*, the setting tool 11 and setting sleeve 13 can be run into the well bore and left or right hand torque can be applied from the surface to the pipe string, mandrel 15, torque fingers 53 and setting sleeve extension 13 to manipulate a conventional hanger mechanism to hang the liner in the well bore.

The liner, which is carried below the setting sleeve, is hung in the conventional manner, as by setting gripping slips located along a portion of the liner exterior. Once the liner is hung within the well bore, weight is taken off the pipe string, below the setting tool 11, allowing weight to be set-down on the pipe string above the setting tool from the surface. This action causes the shear pins 71 to shear and overcomes the preload in coil spring 63, allowing sliding movement of the mandrel 15 within the setting nut 47 until the spring sleeve 105 contacts the upper ledge 121 of the torque collar 55, as shown in FIG. 2*b*. The port 107 of the spring sleeve 105 allows any trapped well fluids in the interior of the sleeve 105 to pass to the outside of the tool during the sliding movement of the mandrel 15. The weight of the pipe string above the setting tool 11 is now carried on the upper ledge 121 of the torque collar 55 and the bearing mechanism allows rotational movement of the mandrel 15 with respect to the stationary setting sleeve extension 13 without a load being imposed upon the connecting threads 43, 45.

The torque transmitting splines 73 carried about the mandrel exterior have now moved into a clearance 124 (FIG. 2*b*) with respect to the splined ring 77, allowing rotational movement of the splines 73 within the torque collar 55. This allows the setting nut 47 to be unthreaded by applying right hand torque to the mandrel 15. The application of right hand torque from the surface through the pipe string is thus transmitted through the splines 73 to the setting nut 47, to cause relative movement between the setting nut connecting threads 45 and the internal connecting threads 43 of the setting sleeve. As best seen in FIG. 3*b*, the setting nut 47 moves up the threaded surface 43 to the disengaged position shown. Once the setting nut has been completely disengaged, the setting tool 11 can be pulled out of the setting sleeve extension 13 and raised to the well surface.

The setting tool can also be released without the application of weight from the surface by means of a torque override made up of the shear screws 71 and shear pins 83 (FIG. 1*b*). Upon the application of a predetermined rotational torque to the mandrel 15, shear pins 71 and 83 are sheared to thereby allow relative rotational movement between the connecting threads 43, 45 without the application of downward force to the mandrel 15 or downward sliding movement of the mandrel 15 with respect to the torque collar 55. The shear pins 71 and 83 are selectively sized to prevent inadvertent shearing during setting operations, but at the same time, allow rotational release upon the application of sufficient force from the surface.

Although the setting tool can be retrieved to the well surface at this point, operators sometimes wish to set the setting tool back down on the upper circumferential edge 61 of the setting sleeve 13. The spring loaded torque fingers 53 are retractable within the longitudinal openings 57 in case the torque fingers 53 do not line up axially with the end notches 51 of the setting sleeve extension 13. As shown in FIG. 3*b*, the torque fingers 53 would then rest upon the upper circumferential edge 61 to prevent damage to the torque fingers.

The four pointed torque transmitting splines 73 and facing end points 91, 93 of the splined ring 77 automatically align the spline 73 for reentry of the splines within the splined ring 77 when weight is taken off the setting tool as shown in FIG. 5.

Figure 6A:
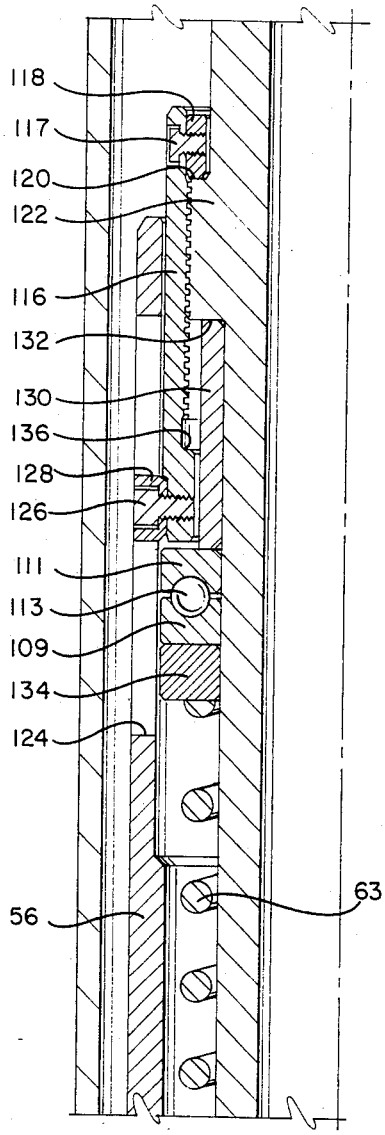
FIG. 6*a* is a side, partial cross-sectional view of another embodiment of the upper end of the setting tool which allows rotation of the liner after release of the setting tool.
Figure 6B:
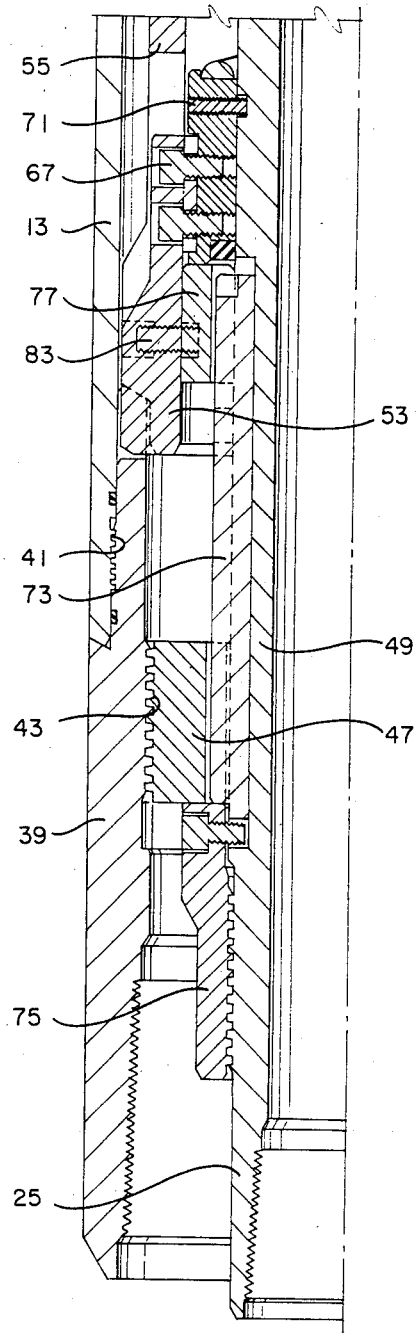
FIG. 6*b* is a downward continuation of the device of FIG. 6*a* in the running-in position.

FIGS. 6*a* and 6*b* show another embodiment of the setting tool 11 of the invention which allows rotation of the setting sleeve sub 39, and hence the liner, after the setting nut 47 has been disengaged from the threaded profile 43. It is sometimes desirable to be able to rotate the liner as the liner is being cemented in place. It is also desirable that the setting nut 47 be disengaged at this point in the operation, in order to assure that the setting tool can be retrieved to the well surface once the operation is complete.

In the design shown in FIGS. 6*a* and 6*b*, the torque collar 55 is extended upwardly to form a surrounding sleeve 56 (FIG. 6*a*) which surrounds the coil spring 63, bearing arrangement 109, 111, 113, and collar 116. Collar 116 has an internally threaded surface 118 which engages mating threads on the region 122 of the tubular mandrel 15. The surrounding sleeve 56 also has a slot 124 into which a guide pin 126 and nut 128 are slidably received. A spacer 130 is received between a shoulder 132 of region 122 and the upper race 111 of the bearing arrangement. The lower bearing race 109 is separated by a spacer ring 134 from the upper extent of the coil spring 63.

FIGS. 6*a* and 6*b* show the device in the running-in position. The torque fingers 53 are engaged within the end notches of the setting sleeve extension and shear pins 71 prevent sliding movement of the tubular mandrel. Once the device has been run to the desired depth and the liner hanger is set, weight can be applied through the pipe string from the well surface, thereby shearing pins 71 and allowing the splines 73 to move from within the splined ring 77. Right hand rotation of the pipe string from the well surface now causes the threaded surface 118 to travel up the threaded region 122 until the shoulder 132 contacts shoulder 136 within collar 116. As this action occurs, the setting nut 47 also travels up the threaded profile 43 and is disengaged from the surrounding setting sleeve extension. The setting tool 11 can now be lifted to test disengagement of the threads 43.

The setting tool 11 can now again be lowered until the tool rests upon the upper circumferential edge 61 (best shown in FIG. 3*b*) of the setting sleeve 13. At this point, the spring loaded torque fingers 53 may not be aligned with the end notches 51 of the setting sleeve extension. However, since the shoulder 132 of the mandrel region 122 has now "bottomed out" on the shoulder 136 of collar 116, further right hand rotation of the pipe string causes torque to be applied from the tubular mandrel through the guide pin 126 to the surrounding sleeve 56. By applying right hand torque to the sleeve 56, the torque fingers 53 can be rotated until they fall into the end notches of the setting sleeve extension. Further right hand rotation of the pipe string now serves to rotate the setting sleeve extension 39 and, in turn, the depending liner. If the operator desires to again pick up the setting tool, the tool can be again latched to the liner setting sleeve by setting down weight and rotating until the torque fingers 53 reengage their respective end notches 51.

The devices can be released from the running-in position shown in FIGS. 6*a* and 6*b* without setting down weight upon the pipe string. Once the liner has been hung in the well bore, right hand torque applied through the pipe string from the well surface can be used to shear pins 71 and 83. Continued rotation causes threads 118 to move over the threaded region 122 until shoulder 132 contacts shoulder 136. The application of additional, predetermined torque will shear pin 126. Since the splined ring 77 is no longer connected to the torque fingers 53, torque can be applied through the splines 73 to unthread the setting nut 47 and the tool can be retrieved to the well surface.

An invention has been provided with several advantages. Once the setting tool of the invention has been run into the well bore, either left or right hand torque can be applied from the surface to the setting sleeve to perform well bore operations without releasing the setting tool from the setting sleeve. By setting weight down on the setting tool, right hand torque can be applied from the surface to disengage the setting tool from the setting sleeve, allowing the setting tool to be withdrawn from the setting sleeve and raised to the surface. The provision of right hand set and right hand release removes the possibility of unthreading tool joints in the pipe string during well bore manipulations.

The present setting tool design has a spring preload to bias the tool toward the extended running-in position and is fixed by shear screws to prevent movement of the mandrel until sufficient downward force is applied from the surface. A torque override feature allows the setting tool to be released from the setting sleeve by applying sufficient rotational force from the surface without applying downward force.

Torque is transmitted between the setting tool and setting sleeve by means of a plurality of spring loaded, retractable torque fingers. Since the torque fingers slide axially in planes parallel to the longitudinal axis of the tool, the problem of sand jamming radially biased dogs is eliminated. The torque fingers move to a retracted position if the setting tool is rested upon the setting sleeve after disengagement to prevent possible damage to the torque fingers. After orienting the torque fingers with the setting sleeve end notches, the spring biased fingers snap back into torque transmitting engagement with the setting sleeve. A special key arrangement facilitates reentry of the torque transmitting splines within the torque collar which are used to disengage the setting nut as the setting tool is moved between the extended running-in and weight set-down positions.

In one embodiment of the device, a surrounding sleeve is provided with a slot for receiving a guide pin which allows torque to be transmitted through the pipe string to the torque fingers for reengaging the torque fingers within the setting sleeve extension end notches. The torque fingers can be reengaged after the setting nut has been released, allowing the liner to be rotated after disengagement of the setting nut. This allows the tool to be used to rotate a liner, as during cementing of the liner, while assuring that the setting tool is disengaged and can be retrieved to the well surface without difficulty.

While the invention has been shown in only two of its forms, it will be appreciated that it is not thus limited but is susceptible to various changes and modifications without departing from the spirit thereof.

We claim:

1. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel;

said mandrel being slidably disposed within said setting nut when said setting nut is engaging said setting sleeve, said mandrel being slidable between an extended, running-in position and a weight set-down position;

a torque collar carried on said mandrel exterior for transmitting torque from said mandrel to said setting sleeve, said torque collar having at least one torque finger mounted thereon which is axially slidable within a slot provided in said torque collar in a plane which is parallel to the longitudinal axis of the tool, said setting sleeve having at least one end notch adapted to receive said axially slidable torque finger; and latch means within said torque collar for preventing relative rotational movement between said connecting threads of said setting nut and said setting sleeve when said mandrel is in said extended, running-in position and allowing relative movement between said connecting threads when said mandrel is in said weight set-down position to release said connecting threads.

2. The setting tool of claim 1 wherein said latch collar is a generally cylindrical member having a lower circumferential edge and wherein said torque finger is spring biased toward a torque transmitting position in which at least a portion of said torque finger extends past said lower circumferential edge and is received within said setting sleeve end notch.

3. The setting tool of claim 2, wherein said torque collar lower circumferential edge rests upon an upper circumferential edge of said setting sleeve when said setting nut is engaging said setting sleeve and wherein said torque finger is engageable with said setting sleeve end notch when said torque finger is axially aligned with said end notch, said torque finger being slidable to a retracted position in which said torque finger is completely received within said slot in said torque collar and in which said torque finger does not extend past said lower circumferential edge when said torque finger is out of axial alignment with said end notch.

4. The setting tool of claim 3, wherein said torque finger is forced to said retracted position by contacting said setting sleeve upper circumferential edge when said torque finger is moved out of axial alignment with said end notch.

5. The setting tool of claim 4, wherein a plurality of axially slidable torque fingers are mounted equidistantly about the exterior of said mandrel for alignment with mating end notches provided in said setting sleeve.

6. A setting tool of the type adapted to be made up in a pipe string releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel, said setting nut having at least one axial groove in the interior thereof;

said mandrel being slidably disposed within said setting nut when said setting nut is engaging said setting sleeve, said mandrel being slidable between an extended running-in position and a weight set-down position;

a torque collar carried on said mandrel exterior for transmitting torque from said mandrel to said setting sleeve having at least one torque finger mounted thereon which is axially slidable on an external surface of said torque collar in a plane which is parallel to the longitudinal axis of the tool, said setting sleeve having at least one end notch adapted to receive said torque finger;

latch means within said torque collar for preventing relative rotational movement between said connecting threads of said setting nut and said setting sleeve when the mandrel is in said extended running-in position and allowing relative movement between said connecting threads when said mandrel is in said weight set-down position to release said connecting threads;

at least one torque transmitting spline on said mandrel exterior, a portion of said spline being received within said setting nut axial groove to allow torque transmitted to said mandrel to be transmitted to said setting nut when said mandrel is in said weight set-down position, another portion of said spline being received within a mating interior surface of said torque collar when said mandrel is in said extended, running-in position to thereby prevent the transmission of torque to said setting nut; and key means on said mating interior surface of said torque collar for orienting said torque transmitting spline during receipt of said spline within said torque collar.

7. The setting tool of claim 6, wherein said mandrel exterior is provided with a plurality of torque transmitting splines spaced equidistantly about said mandrel exterior, said splines having pointed upper ends for contacting said mating interior surface of said torque collar for orienting said torque transmitting splines during receipt of said splines within said torque collar.

8. A method of setting a liner in a well bore using a setting tool of the type adapted to be made up in a pipe string for releasably engaging a setting sleeve in a well bore, comprising the steps of:

connecting a mandrel in the pipe string which has a setting nut with external connecting threads for engaging mating connecting threads located on the interior of a setting sleeve disposed about said mandrel, the mandrel being slidably disposed within said setting nut when said setting nut is engaging said setting sleeve, said mandrel being slidable between an extended, running-in position and a weight set-down position;

mounting a torque collar on said mandrel exterior, said torque collar having at least one torque finger mounted thereon which is axially slidable on an external surface of said torque collar in a plane which is parallel to the longitudinal axis of the tool, said setting sleeve having at least one end notch adapted to receive said axially slidable torque finger;

initially latching the mandrel to the setting sleeve with each torque finger received within its respective end notch;

setting weight down on the pipe string from the well surface to release the latch and allow relative movement between the connecting threads of the setting nut and setting sleeve;

applying right hand torque to the pipe string to release the connecting threads of the setting nut from the setting sleeve;

temporarily lifting the pipe string and setting tool to test the disengagement of the setting nut;

again resting the setting tool on the setting sleeve;

rotating said pipe string to realign said torque finger and said setting sleeve end notch and reengage said torque finger with said end notch; and continuing to rotate to the right to rotate the setting sleeve during subsequent well bore operations.

9. The method of claim 8, wherein the torque fingers are rotated into position by transmitting torque from the mandrel through a guide pin retained in a guide slot of the torque collar.

* * * * *

UNITED STATES PATENT AND TRADEMARK OFFICE

CERTIFICATE OF CORRECTION

PATENT NO. : 4,598,774

DATED : July 8, 1986

INVENTOR(S) : David L. Nevels et al.

It is certified that error appears in the above-identified patent and that said Letters Patent is hereby corrected as shown below:

In the abstract, line 1, "if" is changed to --of--;

In claim 2, line 1, "latch" is changed to --torque--.

Signed and Sealed this

Second Day of December, 1986

*Attest:*

DONALD J. QUIGG

*Attesting Officer*

*Commissioner of Patents and Trademarks*